US010648654B2

(12) United States Patent
Jiang et al.

(10) Patent No.: US 10,648,654 B2
(45) Date of Patent: May 12, 2020

(54) STAGE LIGHTING SOURCE SYSTEM WITH A LAMP PROTECTION FUNCTION

(71) Applicant: Guangzhou Haoyang Electronic Co., Ltd., Guangzhou, Guangdong (CN)

(72) Inventors: Weikai Jiang, Guangdong (CN); Mingjian Yuan, Guangdong (CN)

(73) Assignee: Guangzhou Haoyang Electronic Co., Ltd. (CN)

( * ) Notice: Subject to any disclaimer, the term of this patent is extended or adjusted under 35 U.S.C. 154(b) by 0 days.

(21) Appl. No.: 16/426,804

(22) Filed: May 30, 2019

(65) Prior Publication Data

US 2019/0390850 A1 Dec. 26, 2019

(30) Foreign Application Priority Data

Jun. 22, 2018 (CN) ..... 2018 2 0968554

(51) Int. Cl.

| | |
|---|---|
| ***F21V 29/503*** | (2015.01) |
| ***F21V 29/70*** | (2015.01) |
| ***F21V 7/04*** | (2006.01) |
| ***F21V 9/00*** | (2018.01) |
| *F21W 131/406* | (2006.01) |

(52) U.S. Cl.

CPC ..... *F21V 29/503* (2015.01); *F21V 7/04* (2013.01); *F21V 9/00* (2013.01); *F21V 29/70* (2015.01); *F21W 2131/406* (2013.01)

(58) Field of Classification Search

CPC .. F21V 29/503; F21V 29/15; F21W 2131/406

See application file for complete search history.

(56) References Cited

U.S. PATENT DOCUMENTS

| | | | | |
|---|---|---|---|---|
| 8,820,973 | B2 * | 9/2014 | Quadri | F21V 29/15 362/294 |
| 2004/0057250 | A1 * | 3/2004 | Roberts | F21V 9/04 362/554 |

* cited by examiner

*Primary Examiner* — Robert J May

(74) *Attorney, Agent, or Firm* — Lerner, David, Littenberg, Krumholz & Mentlik, LLP

(57) ABSTRACT

Provided is a stage lighting source system with a lamp protection function. The stage lighting source system comprises a lamp, a lamp protection device and a light filter. All are arranged along a light axis sequentially. The lamp protection device comprises a non-transparent structure and a mounting component for mounting non-transparent structure. Light axis passes through the non-transparent structure. Non-transparent structure size does not affect a lamp light emitting effect in the light axis direction. Non-transparent structure fully or partially absorbs and/or reflects light energy from the light filter. The structure is easy and convenient to use, intercepts light energy reflected from the light filter by using appropriate blocking object and structure, effectively controls lamp electrode temperature within an acceptable range, and ensures lamp service life so that a flat light filter without an included angle is applied, and an ideal optical effect is realized.

13 Claims, 4 Drawing Sheets

STAGE LIGHTING SOURCE SYSTEM WITH A LAMP PROTECTION FUNCTION

CROSS REFERENCE TO RELATED APPLICATIONS

The present application claims priority from Chinese Patent Application No. 201820968554.4 filed Jun. 22, 2018, the disclosures of which are hereby incorporated herein by reference.

TECHNICAL FIELD

The present invention relates to the technical field of stage lighting, and more particularly, to a stage lighting source system with a lamp protection function.

BACKGROUND

When a stage lamp is used, if a light filter thereof is used near a light source, the light filter will reflect a lot of light energy, and a part of the light energy reflected from the light filter and a part of the light energy emitted by the light source are converged on an electrode at an upper end of a lamp post at a central position of a lamp. Especially when the light filter is perpendicular to a light axis, more light energy will be converged on the electrode, thus causing that a temperature of the electrode increases sharply, while an excessively high temperature will seriously shorten a service life of the lamp electrode, thus accelerating the failure of the lamp. Therefore, how to reduce the temperature of the lamp electrode under the premise of ensuring an ideal optical effect of the lamp has become an important research topic in the thermal design of stage lighting.

According to the existing lamp thermal control technologies, in order to make the part of the light energy reflected from the light filter no longer pass through a lamp post electrode, a light filter with a certain included angle is used, so that a temperature of the lamp post electrode is controlled not to exceed a standard, and the service life of the lamp electrode is ensured. However, the light filter with an included angle can cause uneven light color projected by the lamp, so that an ideal optical effect of a flat light filter without an included angle cannot be realized.

SUMMARY OF THE INVENTION

In order to overcome at least one of the defects in the prior art above, the present invention provides a stage lighting source system with a lamp protection function. The present invention is simple in structure and convenient to use, intercepts light energy reflected from a light filter by using appropriate blocking object and structure, effectively controls a temperature of a lamp electrode within an acceptable range, and ensures a service life of a lamp, so that a flat light filter without an included angle is applied, and an ideal optical effect is realized.

In order to solve the technical problems above, the following technical solution is used in the present invention. A stage lighting source system with a lamp protection function comprises a lamp, a lamp protection device and a light filter which are sequentially arranged along a light axis, wherein the lamp protection device comprises a non-transparent structure and a mounting component for mounting the non-transparent structure, the light axis passes through the non-transparent structure, a size of the non-transparent structure does not affect a light emitting effect of the lamp in a direction of the light axis, and the non-transparent structure can fully or partially absorb and/or reflect light energy reflected from the light filter.

In this way, when the stage lighting source system is used, light emitted by the lamp along the light axis sequentially passes through the lamp protection device and the light filter. When the light emitted by the lamp passes through the light filter, a part of the light energy will be reflected, and in the case of no lamp protection device, a lot of the light energy which is reflected will be converged on a lamp post electrode. In addition, a part of the light energy is converged on the lamp post electrode when the lamp originally emits light, which can cause sharp increase of a temperature of the lamp post electrode, while an excessively high temperature can seriously shorten a service life of the lamp post electrode, thus accelerating the failure of the lamp. However, since the lamp protection device is arranged in the present invention, at least part of the light energy reflected from the light filter can be absorbed and/or reflected by the non-transparent structure on the lamp protection device, thus reducing the light energy finally converged on the lamp post electrode, so that the temperature of the lamp post electrode can be effectively controlled within an acceptable range, and the service life of the lamp is ensured. Meanwhile, a flat light filter without an included angle can be applied to realize an ideal optical effect.

Further, the light filter is arranged perpendicular to the light axis, which enables a light color projected by a lamp to be uniform and reach the ideal optical effect.

Further, the mounting component of the non-transparent body is a transparent body. The non-transparent structure is carried by the transparent body with a high light flux to reduce light loss as much as possible and ensure an optical efficiency of stage lighting.

Further, the non-transparent structure is a non-transparent solid fixed on the transparent body, which comprises the following two forms: the first form is that the non-transparent solid is embedded in the transparent body, that is, a center of the transparent body is provided with an opening, the non-transparent solid is embedded in the opening, and a shape of the opening in the center of the transparent body and a shape of a cross-section of the non-transparent solid are not limited; and the second form is that the non-transparent solid is adhered onto the transparent body, and the transparent body does not need the opening. The non-transparent solid can fully or partially absorb and reflect the light energy reflected from the light filter.

Preferably, the non-transparent solid is a ceramic or a metal. Since the non-transparent structure is arranged on the light axis and close to the lamp, and the light axis is a central axis of a light beam formed by the light emitted by the lamp and converged through a reflector cup or a converging lens, the energy is very concentrated, and the ceramic and the metal can not only absorb and reflect the light energy, but also resist a high temperature.

Further, the non-transparent structure is a local coating arranged at a central position of the transparent body. An area and a shape of the coating can be adjusted according to actual application. The coating can fully or partially reflect the light energy reflected from the light filter. Preferably, the transparent body is plate glass.

Further, the stage lighting source system further comprises a lamp cavity, the lamp is arranged inside the lamp cavity, the lamp cavity is provided with a light emitting hole, the light emitting hole is provided with a bracket, the lamp protection device is arranged on the bracket, and the light filter is arranged at a position outside the lamp cavity and corresponding to the light emitting hole.

Preferably, the lamp comprises a reflection cup and a lamp post electrode arranged at an axle center of the reflection cup.

Further, the lamp is fixed on a side wall of the lamp cavity provided with the light emitting hole through a fastener, and a gasket is arranged between the fastener and the side wall.

Further, a side wall of the lamp cavity opposite to the light emitting hole is provided with a louver so as to dissipate heat in the lamp cavity.

Further, the light axis passes through a center of the non-transparent structure. The center is a position where the light energy is most concentrated, and the light energy reflected from the light filter can be absorbed and reflected as much as possible according to the arrangement.

Further, the mounting component is a metal wire. The non-transparent structure is mounted by preferably the metal wire resistant to a high temperature. Due to a small volume of the metal wire, the metal wire has a small effect on interception of the light beam, and an influence on a stage lighting efficiency is minimized to the greatest extent while the implementation of the solution of the present invention is ensured.

Compared with the prior art, the present invention has the following beneficial effects.

According to the present invention, the lamp protection device is arranged between the lamp and the light filter, at least part of the light energy reflected from the light filter can be absorbed and/or reflected by the non-transparent structure on the lamp protection device, thus reducing the light energy finally converged on the lamp post electrode, so that the temperature of the lamp post electrode can be effectively controlled within a acceptable range, and the service life of the lamp is ensured. Especially under a condition that the flat light filter without an included angle is perpendicular to the light axis, not only the use temperature of the lamp is ensured within a reasonable range, but also the ideal optical effect is realized.

DETAILED DESCRIPTION OF THE PREFERRED EMBODIMENT

The accompanying drawings are for illustrative purposes only and shall not be construed as limiting the present invention. In order to better explain the embodiments, some components may be omitted, enlarged or shrunk in the accompanying drawings, which do not represent actual product sizes. For those skilled in the art, some well-known structures in the accompanying drawings and illustration thereof may be omitted. The positional relationship described in the accompanying drawings is for illustrative purpose only and shall not be construed as limiting the present invention.

Embodiment 1

Figure 1:
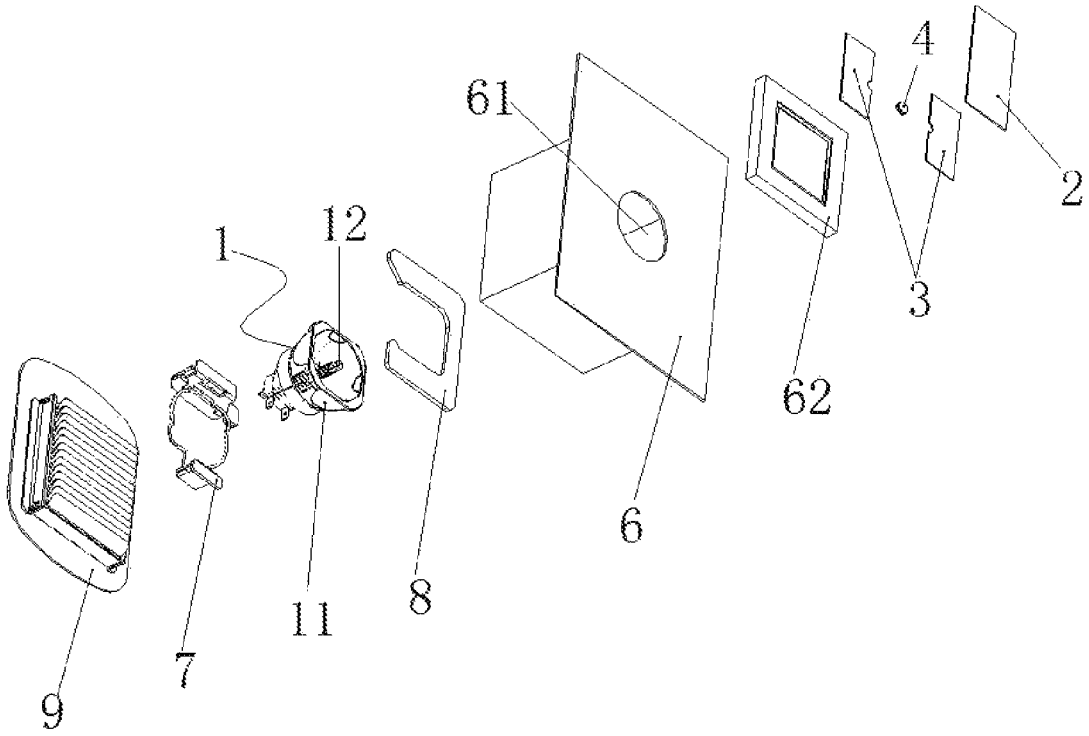
FIG. 1 is an explosive diagram according to an embodiment 1 of the present invention.
Figure 2:
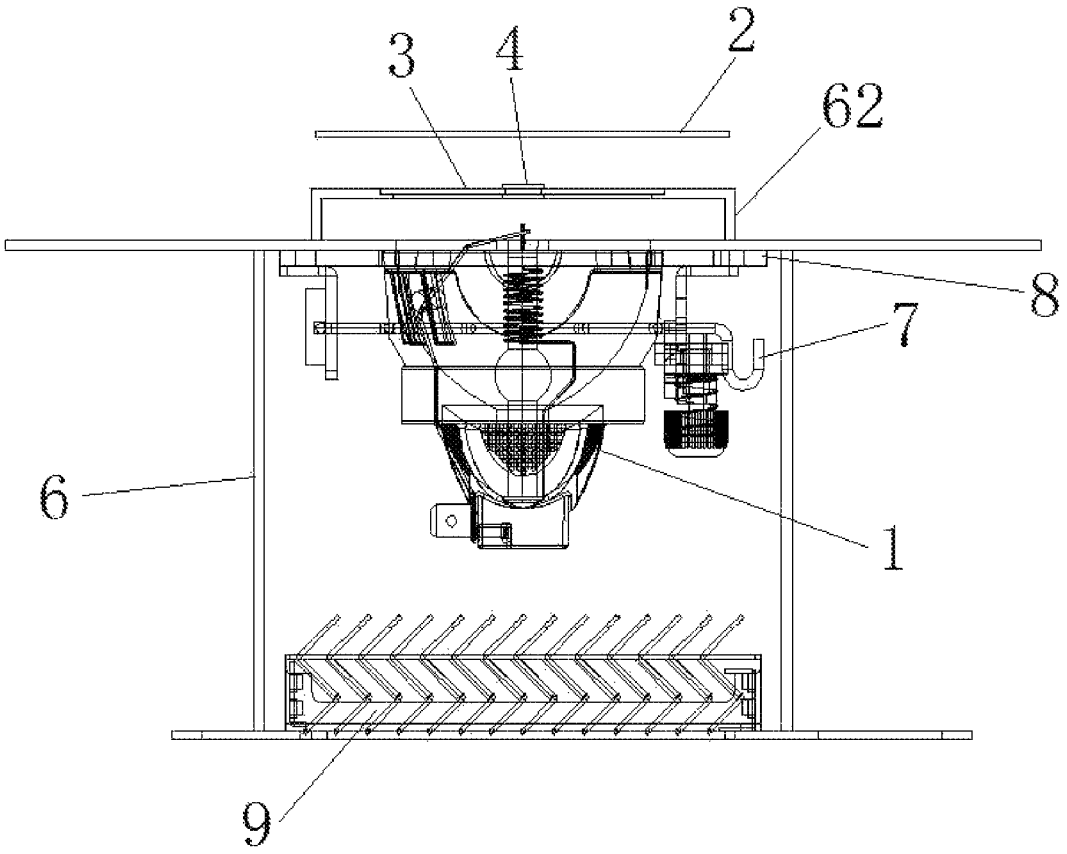
FIG. 2 is a longitudinal cross-section diagram according to the embodiment 1 of the present invention.

As shown in FIG. 1 and FIG. 2, a stage lighting source system with a lamp protection function comprises a lamp 1, a lamp protection device and a light filter 2 which are sequentially arranged along a light axis. The lamp protection device comprises a non-transparent structure and a mounting component for mounting the non-transparent structure, the light axis passes through the non-transparent structure, a size of the non-transparent structure does not affect a light emitting effect of the lamp 1 in a direction of the light axis, and the non-transparent structure can fully or partially absorb and/or reflect light energy reflected from the light filter 2. In this way, when the stage lighting source system is used, light emitted by the lamp 1 along the light axis sequentially passes through the lamp protection device and the light filter 2. When the light emitted by the lamp 1 passes through the light filter 2, a part of the light energy can be reflected, and in the case of no lamp protection device, a lot of the light energy reflected can be converged on a lamp post electrode 12. In addition, a part of the light energy is converged on the lamp post electrode 12 when the lamp 1 originally emits light, which can cause sharp increase of a temperature of the lamp post electrode 12, while an excessively high temperature can seriously shorten a service life of the lamp post electrode 12, thus accelerating the failure of the lamp 1. However, since the lamp protection device is arranged in the present invention, at least part of the light energy reflected from the light filter 2 can be absorbed and/or reflected by the non-transparent structure on the lamp protection device, thus reducing the light energy finally converged on the lamp post electrode 12, so that the temperature of the lamp post electrode 12 can be effectively controlled within an acceptable range, and the service life of the lamp 1 is ensured. Especially under a condition that the flat light filter 2 without an included angle is perpendicular to the light axis, not only a use temperature of the lamp 1 is ensured within a reasonable range, but also the ideal optical effect is realized.

As shown in FIG. 1 and FIG. 2, the light filter 2 is arranged perpendicular to the light axis, which enables a light color projected by a lamp to be uniform and reach the ideal optical effect.

As shown in FIG. 1 and FIG. 2, the mounting component is a transparent body 3. The non-transparent structure is carried by the transparent body 3 with a high light flux to reduce light loss as much as possible and ensure an optical efficiency of a stage light. Preferably, in the embodiment, the transparent body 3 is plate glass. In other embodiments, the transparent body 3 can also be made of other transparent materials, such as plastic.

As shown in FIG. 1 and FIG. 2, the non-transparent structure is a non-transparent solid 4 fixed in the transparent body 3, which comprises the following two forms: the first form is that the non-transparent solid 4 is embedded in the transparent body 3, that is, a center of the transparent body 3 is provided with an opening, the non-transparent solid 4 is embedded in the opening, a shape of the opening in the center of the transparent body 3 and a shape of a cross-section of the non-transparent solid 3 are not limited, the transparent body 3 can be buckled, pasted or fixed by other fixing devices, or the transparent body 3 is directly integrally formed inside the non-transparent solid 4, or the non-transparent solid 4 can be spliced by a plurality of pieces, so as to clamp and fix the transparent body 3; and the second form is that the non-transparent solid 4 is adhered onto the transparent body 3, and the transparent body 3 does not need the opening. The non-transparent solid 4 can fully or partially absorb and reflect the light energy reflected from the light filter 2. The non-transparent solid 4 can be semi-transparent or completely non-transparent.

As shown in FIG. 1 and FIG. 2, the non-transparent solid 4 is a ceramic or a metal. Since the non-transparent structure is arranged on the light axis and close to the lamp 1, and the light axis is a central axis of a light beam formed by the light emitted by the lamp 1 and converged through a reflection cup 11 or a converging lens, the energy is very concentrated, and the ceramic and the metal can not only absorb and reflect the light energy, but also resist a high temperature.

As shown in FIG. 1 and FIG. 2, the light axis passes through a center of the non-transparent structure. The center is a position where the light energy is most concentrated, and the light energy reflected from the light filter 2 can be absorbed and reflected as much as possible according to the arrangement.

As shown in FIG. 1 and FIG. 2, the mounting component is a metal wire. The non-transparent structure is fixed by the metal wire, the non-transparent structure is mounted preferably by the metal wire resistant to a high temperature. Due to a small volume of the metal wire, the metal wire has a small effect on interception of the light beam, and an influence on a stage lighting efficiency is minimized to the greatest extent while the implementation of the solution of the present invention is ensured.

As shown in FIG. 1 and FIG. 2, the stage lighting source system further comprises a lamp cavity 6, wherein the lamp 1 is arranged inside the lamp cavity 6, the lamp cavity 6 is provided with a light emitting hole 61, the light emitting hole 61 is provided with a bracket 62, the lamp protection device is arranged on the bracket 62, and the light filter 2 is arranged at a position outside the lamp cavity 6 and corresponding to the light emitting hole 61. The lamp cavity 6 can prevent the light of the lamp 1 from being leaked out, so that the light is emitted from the light emitting hole 61 as much as possible.

As shown in FIG. 1 and FIG. 2, the lamp 1 comprises a reflection cup 11 and a lamp post electrode 12 arranged at an axle center of the reflection cup 11. The reflection cup 11 reflects the light emitted by the lamp post electrode 12 and the light reflected from the light filter 2 at an angle as parallel as possible to enhance a brightness of the lamp.

As shown in FIG. 1 and FIG. 2, the lamp 1 is fixed in a side wall of the lamp cavity 6 provided with the light emitting hole 61 by a fastener 7, and a gasket 8 is arranged between the fastener 7 and the side wall.

As shown in FIG. 1 and FIG. 2, a side wall of the lamp cavity 6 opposite to the light emitting hole 61 is provided with a louver 9 so as to dissipate heat in the lamp cavity 6.

Embodiment 2

Figure 3:
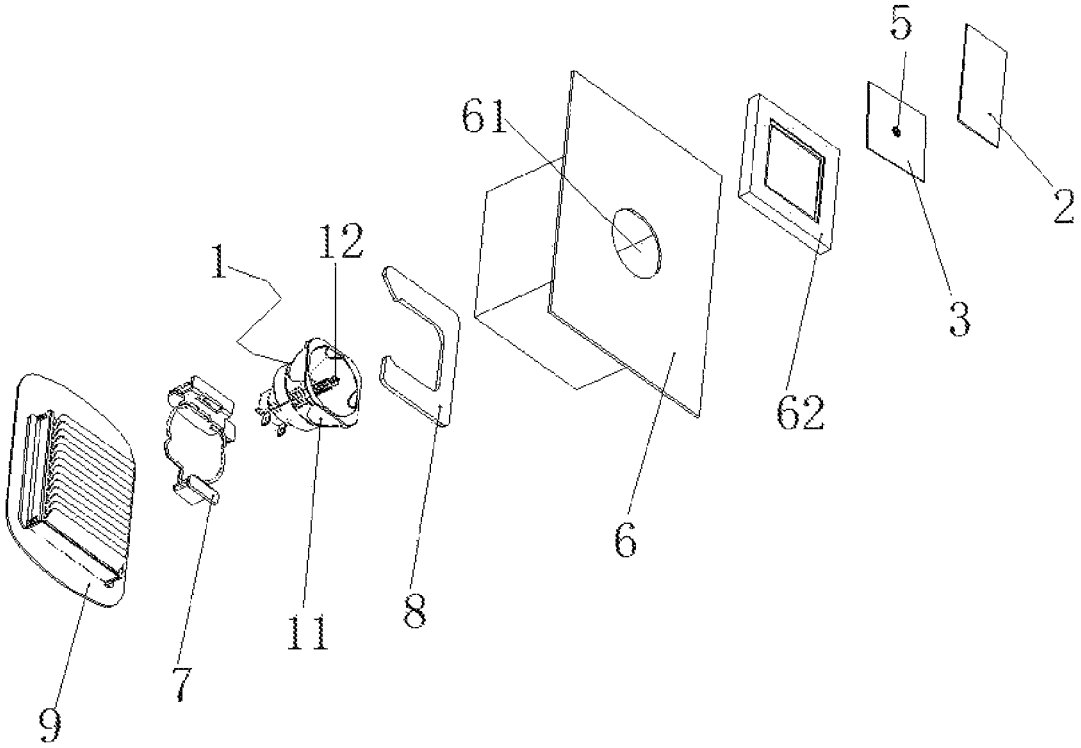
FIG. 3 is an explosive diagram according to an embodiment 2 of the present invention.
Figure 4:
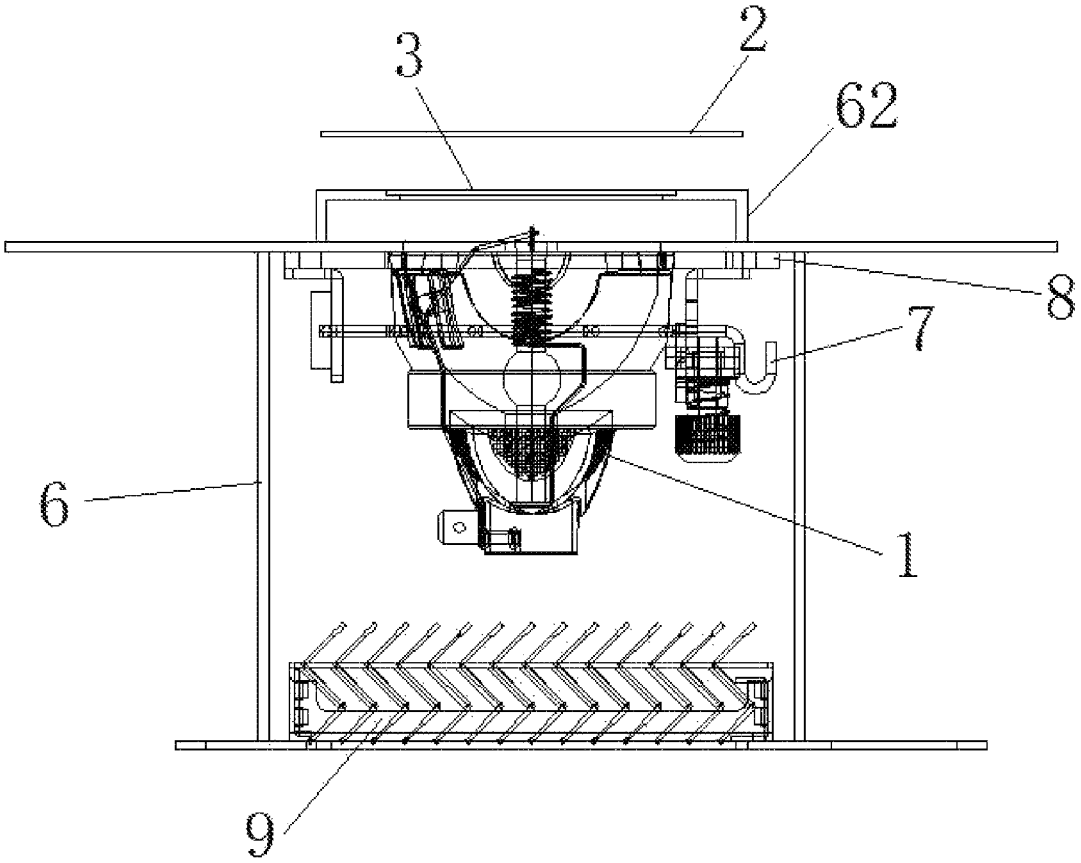
FIG. 4 is a longitudinal cross-section diagram according to the embodiment 2 of the present invention.

The embodiment is similar to the embodiment 1, and the difference lies in that, as shown in FIG. 3 and FIG. 4, the non-transparent structure is a local coating 5 arranged at a central position of the transparent body 3. An area and a shape of the coating 5 can be adjusted according to actual application. The coating 5 can fully or partially reflect the light energy reflected from the light filter 2. Other structures and working principles of the embodiment are the same as those of the embodiment 1.

Obviously, the above embodiments of the present invention are only examples for clearly describing the present invention, but are not intended to limit the implementations of the present invention. Those of ordinary skills in the art can also made other different forms of changes or variations on the basis of the description above. All the implementations are not necessarily and cannot be exhaustive here. Any modifications, equivalents, and improvements made within the spirit and principle of the present invention shall all fall within the scope of protection claimed in the present invention.

What is claimed:

1. A stage lighting source system with a lamp protection function, comprising a lamp, a lamp protection device and a light filter which are arranged along a light axis sequentially, wherein the lamp protection device comprises a non-transparent solid and a mounting component for mounting the non-transparent solid, the light axis passes through the non-transparent solid, a size of the non-transparent solid does not affect a light output effect of the lamp in a direction of the light axis, and the non-transparent solid is a ceramic or a metal that can fully or partially absorb and/or reflect light energy reflected from the light filter.

2. The stage lighting source system with the lamp protection function according to claim 1, wherein the light filter is arranged perpendicular to the light axis.

3. The stage lighting source system with the lamp protection function according to claim 2, wherein the transparent body is plate glass.

4. The stage lighting source system with the lamp protection function according to claim 1, wherein the mounting component is a transparent body.

5. The stage lighting source system with the lamp protection function according to claim 4, wherein the non-transparent solid is fixed on the transparent body.

6. The stage lighting source system with the lamp protection function according to claim 5, wherein the non-transparent solid is embedded in the transparent body, a center of the transparent body is provided with an opening, and the non-transparent solid is embedded in the opening.

7. The stage lighting source system with the lamp protection function according to claim 4, wherein the non-transparent solid is a local coating arranged at a central position of the transparent body.

8. The stage lighting source system with the lamp protection function according to claim 1, further comprising a lamp cavity, wherein the lamp is arranged inside the lamp cavity, the lamp cavity is provided with a light emitting hole, the light emitting hole is provided with a bracket, the lamp protection device is arranged on the bracket, and the light filter is arranged at a position outside the lamp cavity and corresponding to the light emitting hole.

9. The stage lighting source system with the lamp protection function according to claim 8, wherein the lamp is fixed on a side wall of the lamp cavity provided with the light emitting hole by a fastener, and a gasket is arranged between the fastener and the side wall.

10. The stage lighting source system with the lamp protection function according to claim 8, wherein a side wall of the lamp cavity opposite to the light emitting hole is provided with a louver.

11. The stage lighting source system with the lamp protection function according to claim 1, wherein the lamp comprises a reflector cup and a lamp electrode arranged at an axle center of the reflection cup.

12. The stage lighting source system with the lamp protection function according to claim 1, wherein the light axis passes through a center of the non-transparent solid.

13. A stage lighting source system with a lamp protection function, comprising:

a lamp, a lamp protection device, and a light filter which are arranged along a light axis sequentially, wherein the lamp protection device comprises a non-transparent solid and a mounting component for mounting the non-transparent solid, the light axis passes through the non-transparent solid, a size of the non-transparent solid does not affect a light output effect of the lamp in a direction of the light axis, and the non-transparent solid is a ceramic or a metal that can fully or partially absorb and/or reflect light energy reflected from the light filter;

a lamp cavity, wherein the lamp is arranged inside the lamp cavity, the lamp cavity is provided with a light emitting hole, the light emitting hole is provided with a bracket, the lamp protection device is arranged on the bracket, and the light filter is arranged at a position outside the lamp cavity and corresponding to the light emitting hole; and wherein the lamp is fixed on a side wall of the lamp cavity provided with the light emitting hole by a fastener, and a gasket is arranged between the fastener and the side wall.

* * * * *